US006200281B1

(12) United States Patent
Frajdenrajch

(10) Patent No.: US 6,200,281 B1
(45) Date of Patent: Mar. 13, 2001

(54) MASSAGING DEVICE WHICH IS DESIGNED TO BE APPLIED TO THE SKIN OF A PERSON

(76) Inventor: Jean Frajdenrajch, 28 rue Saint-Rome, 31000 Toulouse (FR)

( * ) Notice: Subject to any disclaimer, the term of this patent is extended or adjusted under 35 U.S.C. 154(b) by 0 days.

(21) Appl. No.: 09/369,020

(22) Filed: Aug. 6, 1999

(30) Foreign Application Priority Data

Aug. 6, 1998 (FR) ..... 98 10152

(51) Int. Cl.[7] ..... A61H 7/00
(52) U.S. Cl. ..... 601/84; 601/6; 601/133
(58) Field of Search ..... 601/133, 6, 7, 601/84, 85, 87, 112, 125–127; 15/383, 384, 385, 386, 389, 345, 375

(56) References Cited

U.S. PATENT DOCUMENTS

| | | | | |
|---|---|---|---|---|
| 1,758,962 | * | 5/1930 | Miller | 601/6 |
| 1,980,803 | * | 11/1934 | Johnson | 601/6 |
| 1,983,601 | * | 12/1934 | Conn | 601/6 |
| 2,031,957 | * | 2/1936 | Karlstrom | 15/375 |
| 2,238,541 | * | 4/1941 | Spagnolo | 15/397 |
| 2,290,533 | * | 7/1942 | Campbell, Jr. | 15/385 |
| 2,519,790 | * | 8/1950 | Quinn | 601/6 |
| 2,590,527 | * | 3/1952 | Fluck | 601/7 |
| 2,631,583 | * | 3/1953 | Lavergne | 601/7 |
| 5,377,701 | * | 1/1995 | Fang | 601/6 |
| 5,897,512 | * | 4/1999 | Zagame | 601/6 |
| 6,017,320 | * | 1/2000 | Bleeker et al. | 601/125 |

FOREIGN PATENT DOCUMENTS

| | | |
|---|---|---|
| 0 800 812 | 10/1997 | (EP) . |
| 2057514 | 5/1971 | (FR) . |
| 2579100 | 9/1986 | (FR) . |
| 2723310 | 2/1996 | (FR) . |
| 319489 | 8/1929 | (GB) . |

* cited by examiner

*Primary Examiner*—Justine R. Yu
(74) *Attorney, Agent, or Firm*—Young & Thompson

(57) ABSTRACT

A massaging device which is designed to be applied to the skin of a person, and comprises an outer hollow case (1) which delimits a main suction chamber, the lower edge of which delimits an open surface for application on the skin, and elements for connecting the outer case (1) to a suction source. According to the invention, this massaging device comprises at least one inner case (20), which is disposed in the main suction chamber, which delimits a secondary suction chamber, and has a lower edge which delimits an open surface for application on the skin, elements (4,5,6) for displacement of the inner case (20) relative to the outer case (1), according to motion which is substantially parallel to the plane of the open surface for application of the outer case to the skin, and elements (23) for connection of the inner case (20) to a suction source.

16 Claims, 3 Drawing Sheets

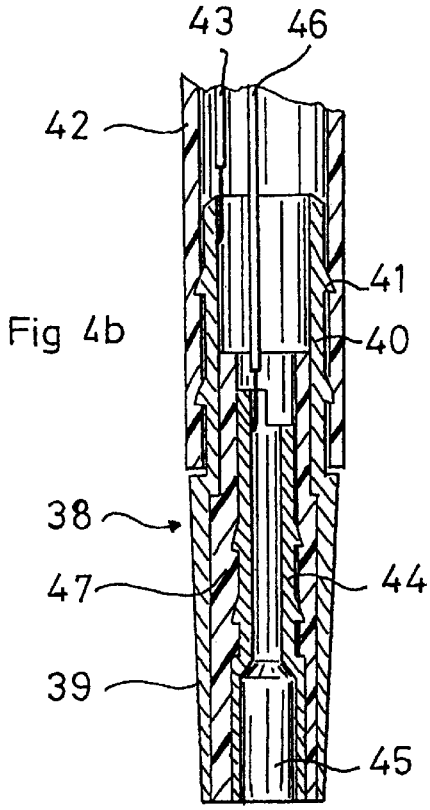
Fig 4b
Fig 3
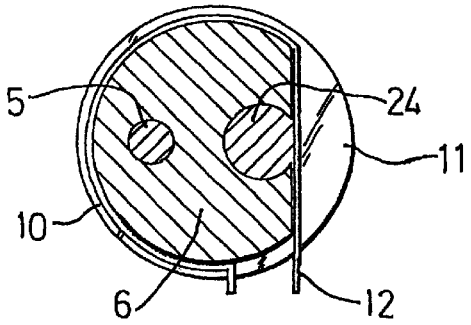
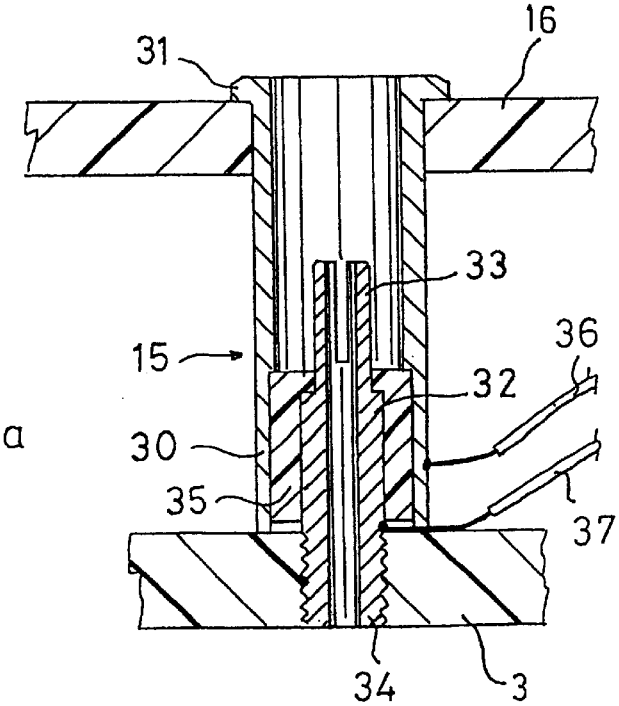
Fig 4a

MASSAGING DEVICE WHICH IS DESIGNED TO BE APPLIED TO THE SKIN OF A PERSON

FIELD OF THE INVENTION

The invention relates to an improved massaging device which is designed to be applied to the skin of a person, in order to form a fold of skin by suction.

BACKGROUND OF THE INVENTION

Massaging devices of this type have been in common use for many years, in various fields such as rehabilitation, sports uses, for aesthetic purposes, and for getting back into shape etc.

These massaging devices comprise mainly a hollow case which delimits a suction chamber provided with an open lower surface, means for connection of this case to a suction source which can generate reduced pressure inside the suction chamber, and means for grasping the case, which can allow the latter to be displaced on the skin.

The operating principle of these massaging devices is as follows: the partial vacuum induced by the suction source sucks the skin inside the suction chamber, and leads to the formation of a fold of skin, which is rolled when the case is displaced on the body of the patient.

In addition, most of these massaging devices, as described in patents FR-2 579 100, FR-2 057 514, FR-2 612 395, FR-2723310, comprise two parallel inner rollers, which are accommodated inside the case, and can form a fold on the skin, the rollers being either associated with drive means to assist displacement of the case, or mounted such as to rotate freely, and disposed so that they can roll on the skin.

However, massaging devices of this type, which mostly make it possible to obtain a relatively efficient massaging action, have two major disadvantages.

In fact, firstly, the massaging action means that it is necessary to displace the massaging device continually on the skin, in order to reproduce the conventional massaging method known by physiotherapists as "palpate and roll". Consequently, even with the aid of motor means to drive the rollers, which are seldom used in practice owing to the cost and size of the massaging devices thus equipped, the user must continually exert force which is designed to obtain this displacement.

In addition, because of their design, massaging devices of this type all involve problems of sealing of the suction chamber, which in practice means that almost systematically, firstly it is necessary to use a suction source with a corresponding level of power and size, and secondly, problems arise in controlling the reduced pressure value inside the suction chamber.

SUMMARY OF THE INVENTION

The object of the present invention is to eliminate these disadvantages, and its main objective is to provide a massaging device which makes it possible to obtain very efficient massaging action, without needing to be displaced on the skin.

Another objective of the invention is to provide a massaging device which requires only a low suction rate, in order to obtain an adequate reduced pressure in the suction chamber.

For this purpose, the invention relates to a massaging device which is designed to be applied to the skin of a person, comprising:

- a hollow case, known as the outer case, comprising a peripheral wall which delimits a suction chamber, known as the main suction chamber, and has a lower edge which delimits an open surface for application on the skin; and
- means for connecting the outer case to a suction source which can generate reduced pressure in the main suction chamber.

According to the invention, this massaging device comprises:

- at least one second hollow case, known as the inner case, with dimensions smaller than those of the outer case, which is disposed in the main suction chamber, the inner case comprising a peripheral wall which delimits a suction chamber, known as the secondary suction chamber, and has a lower edge which delimits an open surface for application on the skin;
- means for displacement of each inner case relative to the outer case, according to motion which is substantially parallel to the plane of the open surface for application of the outer case to the skin; and
- means for making each inner case communicate with a suction source which can generate reduced pressure in the secondary suction chamber.

By means of the combined action of the main massaging head and the secondary massaging head, in the respective suction chambers of which reduced pressure exists, a massaging device of this type makes it possible to form a fold of skin between the peripheral walls of the two cases.

In addition, the displacement of the secondary massaging head inside the main massaging head makes it possible to create a "moving wave", which provides a massage with continually variable intensity, during which the skin is pinched between the peripheral walls of the massaging heads, resulting in an action of compression and "kneading" of the skin.

By means of this design, a massaging device of this type makes it possible to obtain very efficient massaging action, without needing to be displaced on the skin. In addition, the case of the main massaging chamber guarantees perfect sealing of the suction chamber when it is applied to the skin, such that the suction rate which is necessary in order to obtain the reduced pressure can be relatively low, and is perfectly controlled.

According to another characteristic of the invention, the respective lower edges of the outer case and of each inner case extend in substantially parallel planes. In addition, the lower edge of each inner case is preferably slightly recessed relative to the lower edge of the outer case.

According to another characteristic of the invention, the means for communication of each inner case with a suction source comprise at least one aperture which is provided in the upper wall of the inner case, in order to make the secondary suction chamber communicate with the main suction chamber of the outer case.

In addition, this massaging device preferably comprises a single inner case, and means for displacement of the inner case which are designed to displace the latter substantially parallel to the lower edge of the outer case.

Additionally, the lower edges of the inner case and of the outer case are preferably homothetic, and advantageously each have a symmetrical shape, such as circular.

According to another characteristic of the invention, the means for displacement of each inner case comprise:

- a rotary shaft which is mounted on the outer case, such as to be able to pivot around an axis which is substantially at right-angles to the open surface of the outer case;

means for entrainment in rotation of the rotary shaft; and a cam which is integral with the rotary shaft, comprising an eccentric axis which is substantially parallel to the rotary shaft, the inner case being mounted idly around the eccentric axis.

In addition, the means for entrainment in rotation of each rotary shaft are preferably designed to make the said rotary shaft rotate at a speed of rotation which is substantially between 30 rpm and 100 rpm.

According to another characteristic of the invention, each cam contains a bore which is centred on the eccentric axis, each inner case being supported by a shaft which is mounted idly in the bore.

In addition, the distance between centres of the rotary shaft and the eccentric axis is preferably substantially between 4 and 10 mm. This distance between centres can be fixed or variable, in order to adapt to the thickness of the skin.

According to another characteristic of the invention, each inner case is mounted on the cam in a removable manner, the massaging device comprising, for each of the inner cases, a set of at least two interchangeable inner cases, which have open surfaces with different dimensions, for application on the skin.

In addition, the outer case advantageously comprises an outlet tap which is mounted on the peripheral wall of the outer case, in order to regulate the reduced pressure in the main suction chamber.

It also comprises an air intake valve, which is normally closed by the action of resilient means, and is mounted on the peripheral wall of the outer case, in order to establish atmospheric pressure in the main suction chamber.

BRIEF DESCRIPTION OF THE DRAWINGS

Other characteristics, objectives and advantages of the invention will become apparent from the following detailed description, provided with reference to the attached drawings, which represent by way of non-limiting example a preferred embodiment. In these drawings, which are an integral part of the present description:

FIG. 3 is a transverse cross-section through a plane A, which represents the cam of this massaging device;

FIG. 4*a* is a partial longitudinal cross-section on an enlarged scale, of the upper wall of the outer case of this massaging device;

FIG. 4*b* is a longitudinal cross-section on an enlarged scale, of a male connector, for connection of this massaging device to a suction source and to a source of electric current.

DETAILED DESCRIPTION OF THE INVENTION

Figure 1:
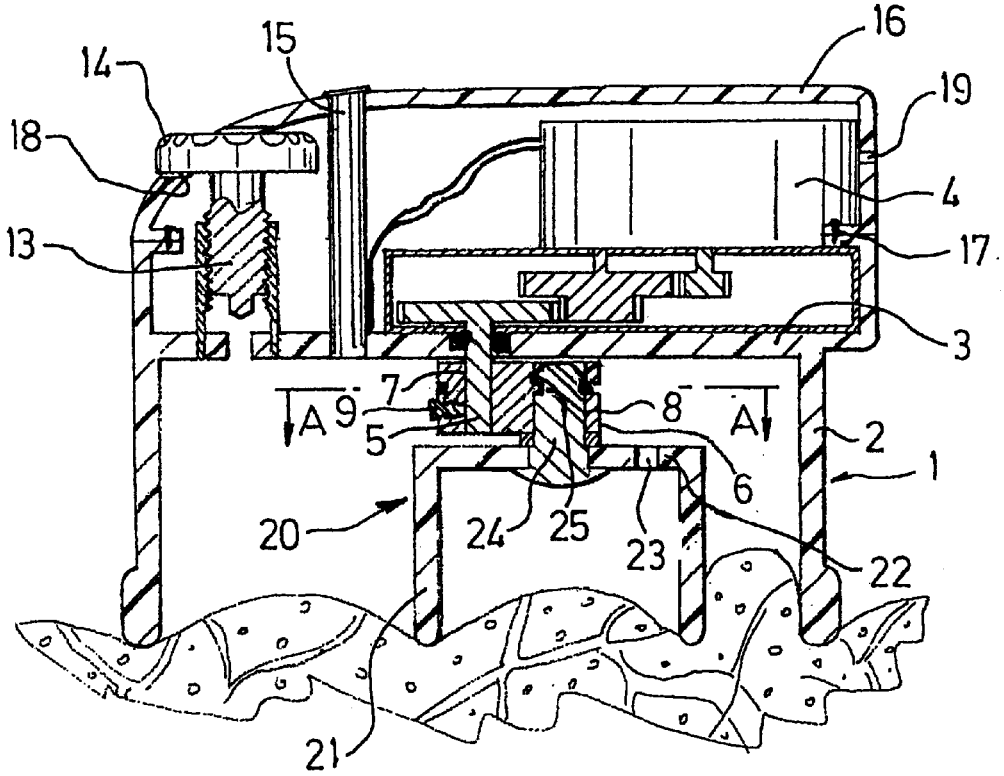
FIG. 1 is a longitudinal cross-section through an axial plane of a massaging device according to the invention, applied to the skin of a patient.
Figure 2:
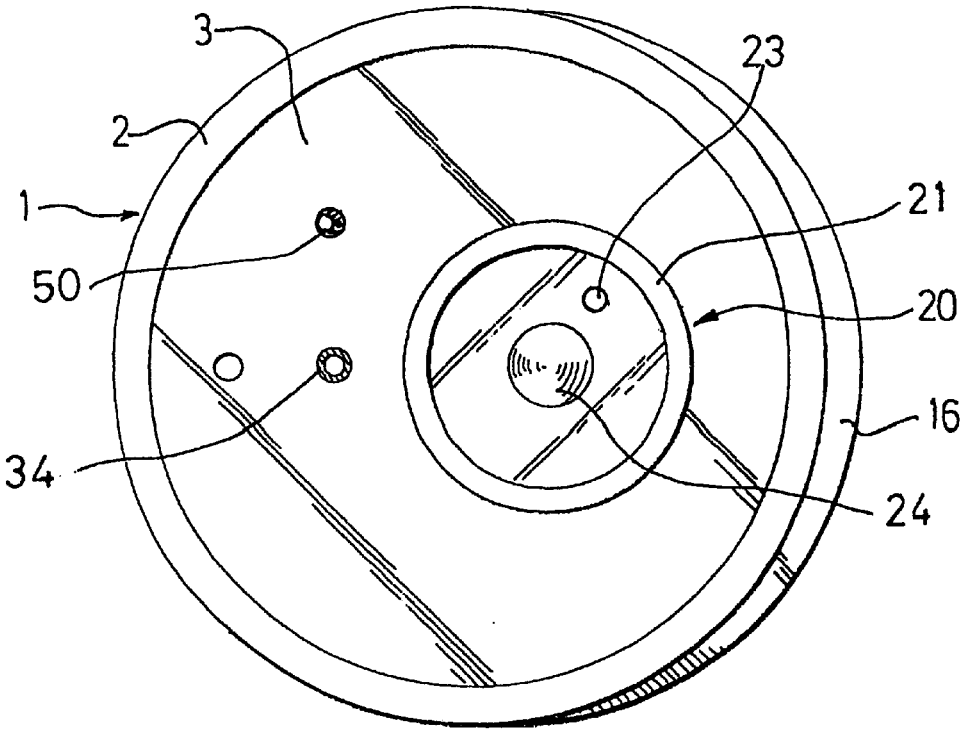
FIG. 2 is a view from beneath of this massaging device.

The massaging device shown in FIGS. 1 and 2 is designed to be applied to a part of the body to be treated, in order to carry out an action of massaging of this part of the body.

This massaging device firstly comprises a main massaging head, which consist of a hollow moulded case 1, which has a generally cylindrical shape which forms a suction chamber, which is delimited by a cylindrical peripheral wall 2 and a circular upper wall 3.

Mounted on the upper wall 3 of the case 1, this massaging device additionally comprises an electric gear motor 4, to rotate a drive shaft 5, which extends axially in the suction chamber, through an axial aperture which is provided in the upper wall 3.

The main massaging head also comprises a cam 6, which is integral with the drive shaft 5, and consists of a disc, through which there are provided longitudinally two eccentric bores 7,8, which have a distance between centres of approximately 5 to 7 mm, i.e.:

a first bore 7 to accommodate the motor shaft 5 (with an o-ring seal interposed), into which there opens a radial bore, which accommodates a screw 9, which renders the cam 6 integral with the motor shaft; and a second bore 8, to fit a secondary massaging head, which is described hereinafter.

This cam 6 additionally comprises a peripheral groove 10, and a linear transverse slot 11, which opens into the base of the groove and into the second bore 8.

Finally, this cam is provided with a spring 12, which consists of an open resilient steel ring, which is designed to be accommodated in the groove 10 and the slot 11 of the cam.

The main massaging head additionally comprises an outlet tap 13, which is mounted on the upper wall 3 of the case 1, and is provided with a knurled wheel 14, which makes it possible to regulate manually the reduced pressure in the suction chamber.

In addition, this main massaging head comprises an air intake valve 50 of a conventional type, which is kept closed by a calibrated spring, and is mounted on the upper wall of the case 1. A first function of a safety valve 50 of this type is to make it possible to establish atmospheric pressure in the suction chamber, in order to displace the massaging device, and to apply it to another area of the human body to be treated. It also constitutes a safety unit which can open, depending on the calibration of the spring, if the reduced pressure in the suction chamber exceeds a pre-determined value.

This main massaging head also comprises a connector 15, to connect firstly the gear motor 4, to a low-voltage electrical supply source, and secondly the suction chamber, to a suction source (shown in FIG. 5), such as an adjustable vacuum pump, which is timed or constant.

As shown in FIG. 4*a,* this connector 15 firstly comprises a tubular female connection 30, which is made of an electrically conductive material, and is provided at its upper end with a collar 31, which is supported on the cover 16 of the massaging device. This female connection 30, which constitutes one of the poles of the connector 15, additionally delimits an inner duct, with a frusto-conical shape which is splayed upwards.

This connector 15 additionally comprises a central cylindrical core 32, which is made of an electrically conductive material, and is disposed axially in the female connection 30, such as to extend firstly, to a partial height inside this connection 30, from the base of the latter, and secondly, partially into the extension of this base.

A central core 32 of this type constitutes firstly the second pole of the connector 15, and secondly a joining piece 33 for communication with a duct for connection to the suction source.

The lower section 34 of this central core 32 is additionally threaded, in order to make it possible to render the connector 15 integral with the main massaging head, by screwing the connector 15 into a threaded aperture which is provided in the upper wall 3 of the outer case 1.

Finally, the connector 15 comprises a sleeve 35, which is made of an electrically isolating material, is accommodated in the lower portion of the female connection 30, and is designed to isolate the female connection and the central core 32 electrically, and to ensure that the central core is centred.

A connector 15 of this type, to which there are connected two electric wires 36,37 to supply the gear motor 4, makes it possible to connect the massaging device, firstly to a suction source, and secondly to a source of electric current, by means of a single male connector 38 which has a matching shape, shown in FIG. 4*b*.

This male connector 38 firstly comprises a tubular joining piece 39, which has an outer frusto-conical shape, which matches that of the female connection 30 of the connector 15, and is designed to fit into the latter.

In its extension, this tubular joining piece 39 comprises a cylindrical sleeve 40, which is provided with outer, projecting circular catches such as 41, which allow the sleeve to be fitted into, and rendered integral with, a tube 42 for connection to a suction source.

This tubular joining piece 39, which is made of an electrically conductive material, constitutes one of the poles of the connector 38, which is supplied by means of an electric wire 43, which extends into the tube 42, and is connected electrically inside the sleeve 40.

This connector 38 also comprises a tubular central core 44 made of an electrically conductive material, which is disposed axially inside the joining piece 39, such as to extend from the base of the latter.

This central core 44 has an inner bore, the lower section 45 of which, which has the larger diameter, is designed to accommodate the joining piece 33 of the connector 15.

This central core 44, which constitutes the second pole of the connector 38, is supplied by means of an electric wire 46, which extends into the tube 42.

Lastly, the connector 38 comprises a sleeve 47 made of an electrically insulating material, which is disposed in the joining piece 39, in the annular space of the latter which is delimited by the central core 44.

Finally, this main massaging head comprises a cover 16 to protect the gear motor 4, which is designed to be mounted on the upper wall 3 of the case 1, and is assembled to the case by means of screws such as 17.

This cover 16 additionally contains an aperture such as 18, through which there extends the knurled wheel 14, the connector 15 and the air intake valve 50, as well as ventilation openings 19 for the gear motor 4.

Figure 5:
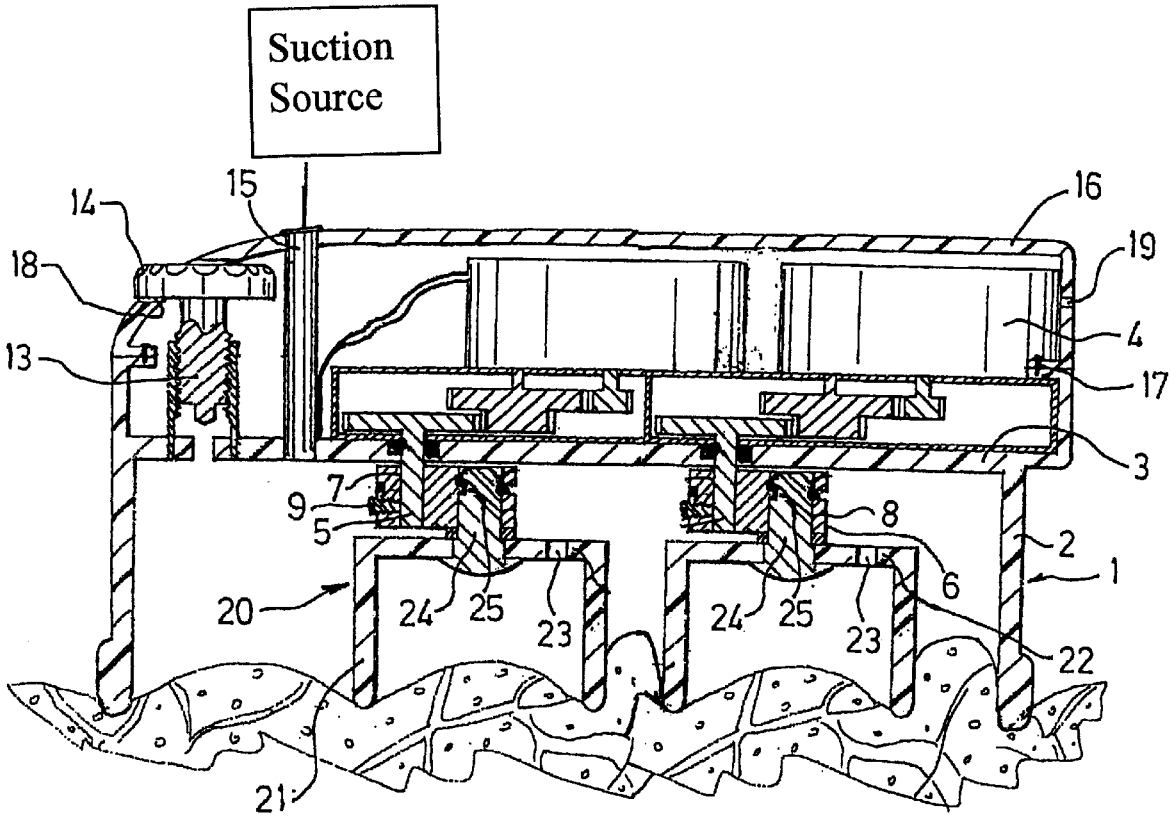
FIG. 5 is a longitudinal cross-section through an axial plane of a massaging device having tow inner cases.

As depicted in FIG. 5, the massaging device according to the invention may additionally comprise a set of secondary massaging heads with different dimensions, each of which is designed to be disposed in the suction chamber of the main massaging head, and is connected in a removable manner to the cam 6.

Each of these secondary massaging heads is in the form of a hollow case 20 with a cylindrical shape, which is made of flexible or rigid material, and forms a suction chamber which is delimited by a cylindrical peripheral wall 21, and a circular upper wall 22, which contains an axial opening, and an opening 23 for communication with the suction chamber of the outer case 1.

Each of these secondary massaging heads is also rendered integral with a rivet 24, the head of which is riveted to the upper wall 22 of the hollow case 20, and the shaft of which, which extends at right-angles above the upper wall, through the axial opening provided in the latter, has a diameter which is designed to be introduced, and to be able to rotate, in the bore 8 of the cam 6.

This shaft of the rivet 24 additionally comprises a peripheral groove 25, which is disposed such as to accommodate an end portion of the spring 12, for locking in translation and maintenance of the secondary massaging head, relative to the cam 6.

By means of the combined action of the main massaging head and the secondary massaging head, when it is applied to the skin of a person, a massaging device of this type makes it possible to create a "radially moving annular wave" between the peripheral walls 2, 21 of the two cases 1, 20, which leads to a very efficient massaging action of the corresponding area of the patient, giving rise to an effect of compression and "kneading" of the dermis.

In addition, the interchangeable nature of the secondary massaging heads makes it possible to provide each massaging head with a set of secondary massaging heads of different sizes, which are mounted on the main massaging head in succession, one after another in increasing order of size, such as to obtain a massaging action, the intensity of which increases progressively.

In addition, it should be noted that the lower edges of the peripheral walls 2, 21 of the cases 1, 20 can be either straight, as shown in FIGS. 1,2, or they can have undulations, the effect of which is to make the skin undergo a pinching effect which has an alternative form, around the entire periphery of the cases.

In addition, these peripheral walls 2, 21 can be cylindrical, as shown in the figures, or they can have a slightly frusto-conical shape, with a cross-section which decreases downwards for the inner case 20, and conversely, a cross-section which increases downwards for the outer case 1, in order to facilitate the "release" of the fold of skin which is formed between the peripheral walls.

In addition, the reduced pressure inside the suction chambers can be kept constant, or it can be adjusted continuously or sequentially, in order to vary the amplitude of the massaging action.

In addition, the gear motor 4 can be integrated in the massaging device, as shown in the figures, or separated from the latter. The same applies to the suction source.

Finally, this massaging device can be used unaltered, for example by an individual. On the other hand for the purposes of professional use, in particular by physiotherapists, beauticians etc, it is preferable to use a "multiple head massage" massaging device, comprising a plurality of massaging devices as previously described, supplied by a single generator.

What is claimed is:

1. A massaging device which is designed to be applied to the skin of a person, comprising:

a hollow outer case having a peripheral wall which delimits a main suction chamber, and has a lower edge which delimits an open surface for application on the skin;

connection means for connecting the outer case to a suction source which can generate reduced pressure in the main suction chamber;

at least one second hollow inner case having dimensions which are smaller than the dimensions of the outer case; said inner case being disposed in the main suction chamber and having a peripheral wall which delimits a secondary suction chamber, and a lower edge which delimits an open surface for application on the skin;

displacement means for displacing each inner case relative to the outer case in a direction which is substantially parallel to a plane of the open surface;

communication means for making each inner case communicate with a suction source which can generate reduced pressure in the secondary suction chamber.

2. The massaging device according to claim 1, wherein the respective lower edges of the outer case and of each inner case extend in substantially parallel planes.

3. The massaging device according to claim 2, wherein the lower edge of each inner case is slightly recessed relative to the lower edge of the outer case.

4. The massaging device according to claim 1, wherein the communication means of each inner case comprise at least one aperture which is provided in the peripheral wall of the inner case in order to make the secondary suction chamber communicate with the main suction chamber of the outer case.

5. The massaging device according to claim 1, wherein the displacement means are structured and arranged to displace the inner case substantially parallel to the lower edge of the outer case.

6. The massaging device according to claim 2, wherein the lower edge of the inner case and of the outer case are homothetic.

7. The massaging device according to claim 6, wherein the lower edges of the inner case and of the outer case each have a symmetrical shape.

8. The massaging device according to claim 7, wherein the lower edges of the inner case and of the outer case are circular.

9. The massaging device according to claim 1, wherein the displacement means of each inner case comprise:

a rotary shaft mounted on the outer case and pivotable around an axis which is substantially at right angles to the open surface;

entrainment means for entraining the rotary shaft in rotation; and a cam integral with the rotary shaft, and having an eccentric axis which is substantially parallel to the rotary shaft; the inner case being mounted idly around the eccentric axis.

10. The massaging device according to claim 9, wherein the entrainment means are designed to rotate the rotary shaft at a speed of rotation which is substantially between 30 rpm and 100 rpm.

11. The massaging device according to claim 9, wherein each cam contains a bore which is centered on the eccentric axis; each inner case being supported by a shaft which is mounted idly in said bore.

12. The massaging device according to claim 9, wherein the distance between the centers of the rotary shaft and the eccentric axis is substantially between 4 and 10 mm.

13. The massaging device according to claim 9, wherein the entrainment means comprise an electric gear motor.

14. The massaging device according to claim 9, wherein each inner case is mounted on the cam in a removable manner; the massaging device further comprising a set of at least two interchangeable inner cases delimiting open surfaces having different dimensions, for application on the skin.

15. The massaging device according to claim 1, wherein the outer case comprises an outlet tap mounted on the peripheral wall of the outer case, in order to regulate the reduced pressure in the main suction chamber.

16. The massaging device according to claim 1, wherein the outer case comprises an air intake valve structured and arranged to be normally closed by calibrated spring means; said air intake valve being mounted on the peripheral wall of the outer case, in order to establish atmospheric pressure in the main suction chamber.

* * * * *